United States Patent [19]

Gotoh et al.

[11] 4,034,420

[45] July 12, 1977

[54] TEMPERATURE BALANCING METHOD FOR REVERSING HEAT EXCHANGERS

[75] Inventors: Akiyoshi Gotoh; Takumi Mizokawa, both of Kobe; Yukio Sawada, Kako; Taichi Katsuki, Kobe, all of Japan

[73] Assignee: Kobe Steel Ltd., Kobe, Japan

[21] Appl. No.: 671,437

[22] Filed: Mar. 29, 1976

[30] Foreign Application Priority Data

Mar. 27, 1975 Japan ..... 50-38204

[51] Int. Cl.[2] ..... F25J 5/00

[52] U.S. Cl. ..... 165/1; 62/21; 165/97; 236/15 BE

[58] Field of Search ..... 62/37, 21; 165/97, 1; 236/15 BE

[56] References Cited

U.S. PATENT DOCUMENTS

| | | | |
|---|---|---|---|
| 2,084,987 | 6/1937 | Borchardt et al. | 62/21 X |
| 2,730,875 | 1/1956 | Ranke | 62/21 X |

FOREIGN PATENT DOCUMENTS

| | | | |
|---|---|---|---|
| 267,596 | 1/1968 | U.S.S.R. | 62/21 |

*Primary Examiner*—Albert W. Davis, Jr.
*Attorney, Agent, or Firm*—Oblon, Fisher, Spivak, McClelland & Maier

[57] ABSTRACT

Disclosed is a new and improved method for automatically balancing the temperature of a plurality of reversing heat exchanger units provided in parallel relation with each other. The balancing method comprises the steps of: detecting the temperature in portions of each core of the reversing heat exchangers whenever the flow paths of a feed stream and a heat medium stream are changed over, calculating a mean temperature of each core from the said detected values during the most recent certain changeover period from the current time point, calculating a mean temperature for all exchangers from the said calculated mean temperatures of each core, calculating deviation and deviation trend in temperature of respective exchangers depending on a difference between the mean temperature of each core and the mean temperature of all exchangers, feeding back a system deviation in dependence on the said deviation and deviation trend to control valves for balancing the temperature of reversing heat exchangers.

3 Claims, 16 Drawing Figures

TEMPERATURE BALANCING METHOD FOR REVERSING HEAT EXCHANGERS

BACKGROUND OF THE INVENTION

This invention relates to the control of heat exchangers and, more particularly, to a method of balancing the temperature of a plurality of heat exchangers connected in parallel relationship and each having a feed gas stream and a stream of a heat medium such as return gas which are alternately switched over at certain intervals.

In general, it has been a common practice to employ reversing heat exchangers in an air separation plant, whose performance efficiency will vary in dependence on temperature variations among a plurality of heat exchangers. The reversing heat exchanger usually includes a feed air stream, a return gas stream comprising impure nitrogen and oxygen gases, and a separated gas stream comprising product nitrogen and product oxygen. The feed air stream and the return gas stream are alternately and periodically switched over by the control of switching valves, whereas separated gas flows through a fixed heat exchange channel. During the heat exchange process, since the feed air is cooled while passing through a feed air stream channel, impurities contained in the feed air often adhere to the wall of the stream channel in the form of ice or frozen $CO_2$. These can accumulate within the heat exchanger, resulting in unstable operation of the plant. In extreme cases, it becomes impossible to continue the operation of the heat exchangers. It is to solve this problem that the feed air stream and the return gas stream are alternately changed over, thereby preventing the accumulation of such impurities within the heat exchangers during normal operation. By ths expedient, the accumulation of impurities and dry ice are satisfactorily avoided by the vapor pressure difference between such impurities contained in the feed air stream and return gas stream. Since the amount of feed air being supplied to a recitification column will temporarily be reduced for a brief interval during switching operation of the feed air stream and the return gas stream, it is desirable not to switch the streams of all of the heat exchangers at one time but rather to switch them over sequentially, with a fixed time difference between each operation. In order to remove the impurities from the walls of the stream channel in a more effective fashion, it is desirable that the temperature difference between the feed air stream and the return gas stream be maintained within a given acceptable range. In actual practice, however, the temperature difference between the feed air stream and the return gas stream in the heat exchanger is such that the temperature difference is small at the feed air stream inlet end of the heat exchanger and increases towards the opposite end. If this temperature difference exceeds a certain level such that it is intersected by the boundary curve for the evaporation of frozen $CO_2$, removal of the frozen $CO_2$ becomes impossible. This phenomenon is caused by the fact that the specific heat at constant pressure for the low pressure return gas, varies over a limited small range, whereas the specific heat at constant pressure for the high pressure feed air, becomes greater as the temperature decreases. To overcome this problem, it has been a usual practice to provide a reverse flow line for directing gases derived from the rectification column in the reverse direction to the flow of the feed air toward the hot end of the heat exchanger, thereby controlling the temperature difference between the feed air stream and the return gas stream within an acceptable range.

Normally, the reversible heat exchanger of the kind described above has a size of 1200 × 1200 mm in cross section which has been a maximum size in industrial plants from manufacturing considerations. In conventional larger air separation plants, a number of heat exchangers of the above-mentioned size are usually connected in parallel. In these plants, it has been a common practice to monitor a set of thermometers mounted at the middle and the cold end of each heat exchanger, to assist in controlling the flows of feed air and return gas by manually operated flow control valves. This is done so as to maintain the temperatures at the middle and the cold end of each heat exchanger within acceptable ranges. Another expedient proposed in the prior art is to provide an automatic regulator valve at the inlet of the feed air channel of each heat exchanger and provide temperature control device having temperature sensing elements disposed at the outlet of the feed air channel, adapted to be controlled in cascade to provide automatic control. In recently employed large air separation plants, however, twenty or more heat exchanger cores are installed, and the control of individual cores will interfere with each others, resulting in inefficient air separation and hunting. Consequently, disturbances will take place in temperature distribution within the heat exchangers resulting in the production of product gases of low purity and in low heat exchange efficiency.

To solve the above problems, it has therefore been proposed to provide a total control system for a number of heat exchangers instead of controlling the temperature distribution of individual heat exchangers. The total control system is, for example, disclosed in U.S. Pat. No. 3,167,113 entitled "Equalization of Loads on Heat Exchangers" by Louis D. Kleiss. This prior art is concerned with a heat exchange system, not a reversing heat exchanger system, including a plurality of heat exchangers connected in parallel relationship. This prior art system features the provision of temperature sensing elements in a gas feed conduit upstream and downstream from a heat exchanger and additional temperature sensing elements disposed in a product gas conduit upstream of the heat exchanger, to detect temperatures Tx, Ty and Tz. These temperatures can be used to express the performance of the heat exchanger as follows:

$$\text{Performance} = (Tx - Ty) / (Tx - Tz)$$

In this manner, the performance of each heat exchange is calculated, thereby providing an average performance for all of the heat exchangers, which is utilized for controlling valves disposed in the gas feed conduits upstream of the respective heat exchangers thereby equalizing the performance of all the heat exchangers. In another embodiment of this prior patent, temperature sensing elements are disposed in the heat exchanger to sense the temperature difference between hot and cold fluids to provide an output representative of the average temperature difference in the heat exchanger. This output is supplied to a controller which actuates flow control valves disposed in the gas feed conduits upstream of the heat exchangers, to thereby equalize the temperature difference between the hot and cold fluids in each heat exchanger. In this prior art, the performance of each heat exchanger or the temperature difference between the hot and cold fluids are utilized for controlling the flow control valves of the respective heat exchangers without regard to the change-over period of the heat exchangers. Consequently, if the principal concept disclosed in this prior art is applied to a heat exchanger system of the reversing heat exchanger type with a view to equalizing the temperature difference between the hot and cold fluids in each heat exchanger, each individual heat exchanger will be controlled irrespective of the trend in temperature variation of all of the heat exchangers and, therefore, controlled operations of the respective heat exchangers will be interferred with each other causing hunting phenomenon. As a result, a complete thermal balance between all heat exchangers is not obtained, thereby possibly causing disturbances in the temperature distribution in a rectification column so that the purity of product gas is decreased and performance efficiency of the rectification column is lowered as described hereinabove with respect to the control of individual heat exchangers. Another drawback encountered with the prior art resides in that the manufacturing cost of a heat exchanger system is high because of a number of temperature sensing elements disposed in various parts of the heat exchangers. Further, if the temperature difference between hot and cold fluids is detected only at the middle of a heat exchanger, it has a lower value than the average value of the temperature difference between the hot and cold fluids, and has no relation to variations in temperature distribution within the heat exchangers. It is thus concluded that the above method is not suitable for controlling the temperature balance of a number of reversing heat exchangers.

SUMMARY OF THE INVENTION

It is, therefore, an object of the present invention to provide a new and unique method of operating a plurality of reversing heat exchangers so as to overcome the shortcomings encountered in prior art.

According to a first feature of the present invention, there is provided a method of balancing the temperature of a plurality of reversing heat exchangers each containing at least two heat exchanger cores connected in parallel relationship, each heat exchanger having a feed gas stream, a return gas stream and a product gas stream of which the paths of the feed gas stream and return gas stream are alternately changed over. In this temperature balancing method, the temperature of particular stream is measured each time the feed gas stream and the return gas stream are changed over in each heat exchanger. The temperatures of each heat exchanger is measured over certain change-over period, and these values are used for calculating the mean temperature of each heat exchanger, this being a parameter which is controlled. Further, the mean temperature of all heat exchangers is obtained from the mean temperatures of the each heat exchanger and used as the set value with which comparison is made for balancing purpose. The parameter to be controlled and the set value are compared, and at least a certain flows is regulated in dependence on the system deviation between the controlled parameter and the set value.

According to a second feature of the present invention, when the degree of valve opening of someone of the temperature control valves of the reversing heat exchangers goes outside a predetermined control range, it is controlled by comparing the degree of opening with the mean degree of opening of all of the temperature control valves. This mean degree of opening is used as a set value. The information resulting from the comparison is utilized to actuate another automatic valves other than the temperature control valves, in such a manner that the mean degrees of valve opening of all temperature control valves are held within a control range. Thus, continuous control of the temperature balance is achieved by maintaining the degrees of valve openings of the temperature control valves within the control range.

According to a third feature of the present invention, the change-over period of the reversing heat exchanges is automatically varied in dependence on the degree of temperature balance of the reversing heat exchangers while continuing the controls of the first and second features described above. BRIEF DESCRIPTION OF THE DRAWINGS FIG. 1 is a schematic view illustrating various streams of a reversing heat exchanger;

Figure 14:
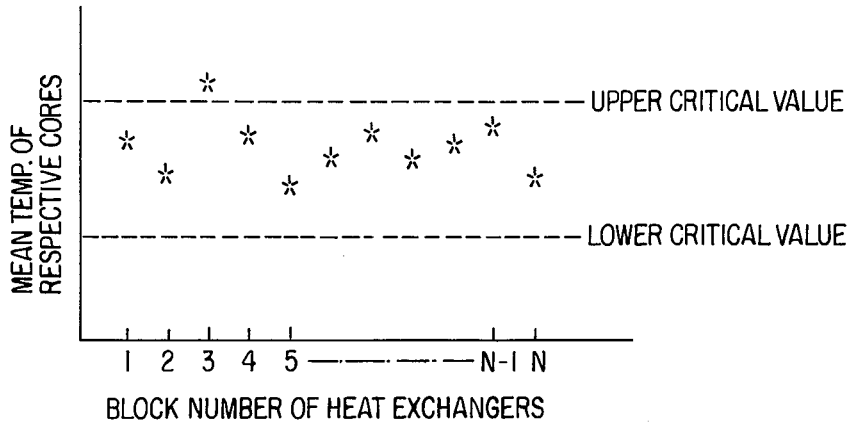
Figure 15:
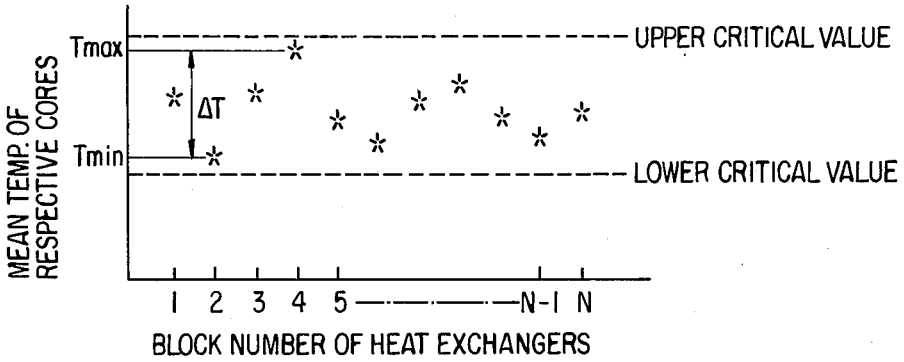
Figure 16:
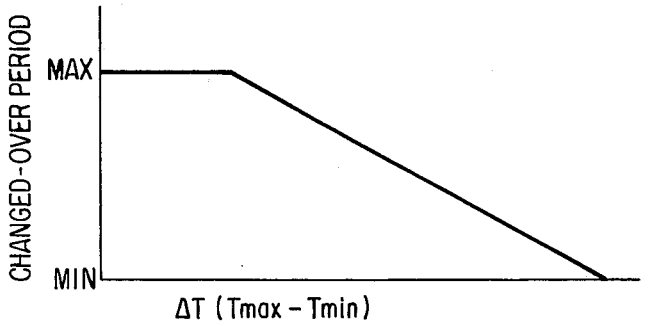

FIGS. 14 and 15 are graphs illustrating a case in which the mean temperature of one heat exchanger exceeds an upper or lower critical value during the most recent change-over period and a case in which the mean temperatures of all heat exchangers remain within a range between the upper and lower critical values, respectively; and FIG. 16 is a graph illustrating the relationship between the change-over period and the temperature balance.

DETAILED DESCRIPTION OF THE INVENTION

A heat exchanger system employing a number of reversing heat exchangers to which a temperature balancing method of the present invention is applied is utilized in processes such as air separation. In such a process, it is necessary to prevent fluctuations in thermal balance of the overall system when temperature control is performed on the reversing heat exchangers. If the thermal balance is maintained in the overall plant system, the thermal balance of the reversing heat exchangers is necessarily stable. It is therefore, necessary to control the temperatures of the reversing heat exchangers such as to maintain the process in a stable condition while also keeping the total amount of heat transfer between feed stream and heat medium within a constant range.

To solve these problem, it is required that characteristics such as flow rates and temperatures of the reversing heat exchangers be analyzed for effectively controlling the temperatures of the reversing heat exchangers, to prevent the thermal balance from being lost. To this end, the most effective method is to calculate the mean temperature of each reversing heat exchanger during a given change-over period and thereby calculate the mean temperature of all heat exchangers. This latter value then becomes the set value and the former values are compared to perform control functions. In this manner, it is possible to maintain the temperature distribution within a range in which the average rate of heat transfer of all heat exchangers is substantially constant thereby performing the control of temperature balance of the heat exchangers in an optimum manner.

While the present invention will now be described with reference to a case in which a temperature balancing method of the present invention is applied to an air separation process, it should be noted that the present method is not limited thereto and it may also be applied to other processes such as process for liquefying natural gas.

Figure 1:
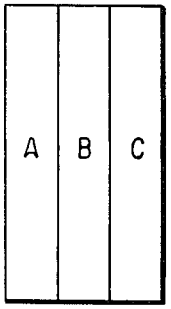
Figure 2:
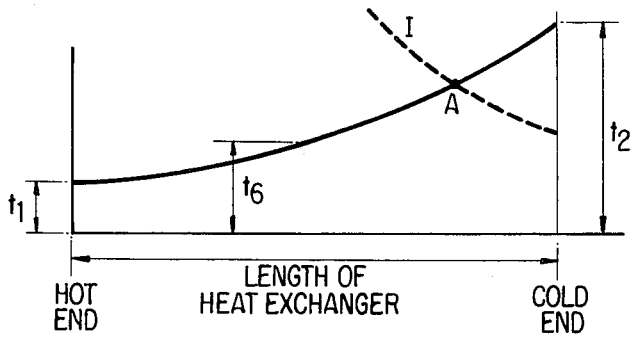
FIG. 2 is a graph illustrating the temperature distribution of an opposed flow type heat exchanger.
Figure 3:
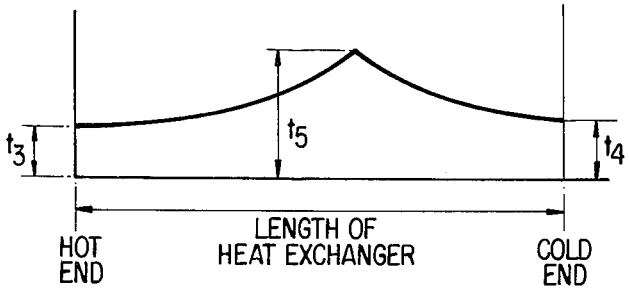
FIG. 3 is a graph illustrating the temperature distribution of the reversing heat exchanger.

As previously noted, the temperature distribution of an opposed flow type heat exchanger is such that the temperature difference between the feed strem and heat medium is small at the hot end of the heat exchanger and large at its cold end as shown in the graph of FIG. 2. If, however, the heat exchanger is equipped with a reverse flow channel such as in the reversing heat exchanger shown in FIG. 1 in which A indicates a feed gas stream channel, B a return gas stream channel and C a product gas stream channel, the temperature distribution of the heat exchanger will vary in a manner as shown in the graph of FIG. 3, and the temperature difference between the feed stream and heat medium will become maximum at the middle of the heat exchanger. The temperature difference $t_5$ at the middle of the heat exchanger is greater than the temperature differences $t_3$ and $t_4$ at the hot and cold ends of the heat exchanger. If a fluctuation occurs in the rate of flow of the return gas stream, the temperature difference $t_5$ will vary in a more sensitive way than the temperature differences $t_3$ and $t_4$ at the hot and cold ends of the heat exchanger. It will thus be seen that temperature control of the reversing heat exchangers can be achieved most effectively by measuring the temperature at the middle of each heat exchanger.

Figure 4:
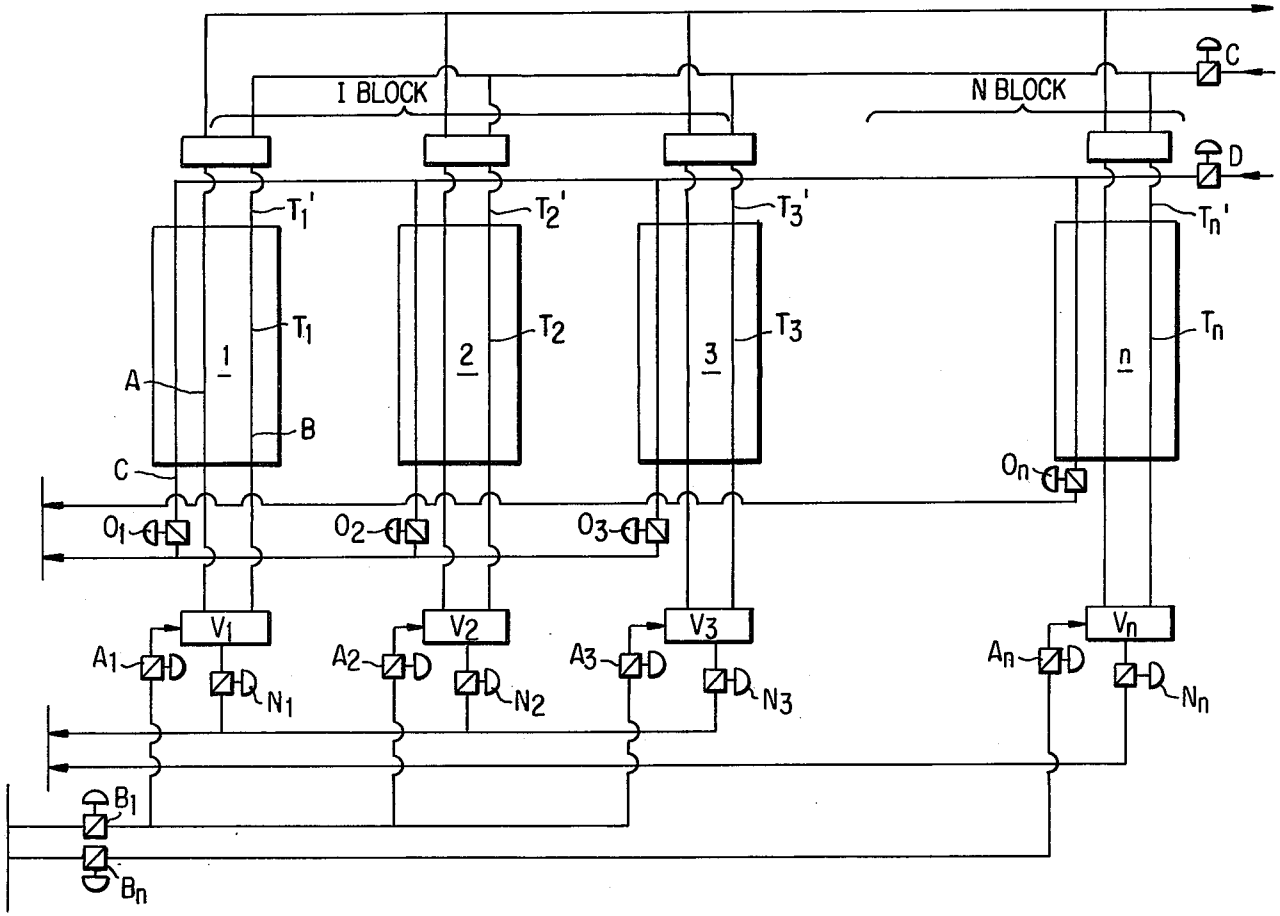
FIG. 4 is a schematic view of a temperature control system for a plurality of reversing heat exchangers in accordance with the present invention.

FIG. 4 shows an example of an air separation plant utilizing a temperature balancing method of the present invention. As shown, the air separation plant comprises a plurality of cores 1, 2, 3, . . . *n* of reversing heat exchangers. Usually, the air separation plant is comprised of a plurality of blocks each consisting of some cores of reversing heat exchangers as represented by I block in FIG. 4. Each of heat exchangers has a feed air stream A, return gas stream B and a product gas stream C as shown in FIG. 1. The switching of the flow paths of air stream A and the return gas stream B is performed sequentially, some bocks at a time, by selective control of switching valves $V_1$, $V_2$, $V_3$, . . . $V_n$ in response to a command signal from a change-over device (not shown) thereby performing heat transfer between the feed air and the return gas.

Figure 5:
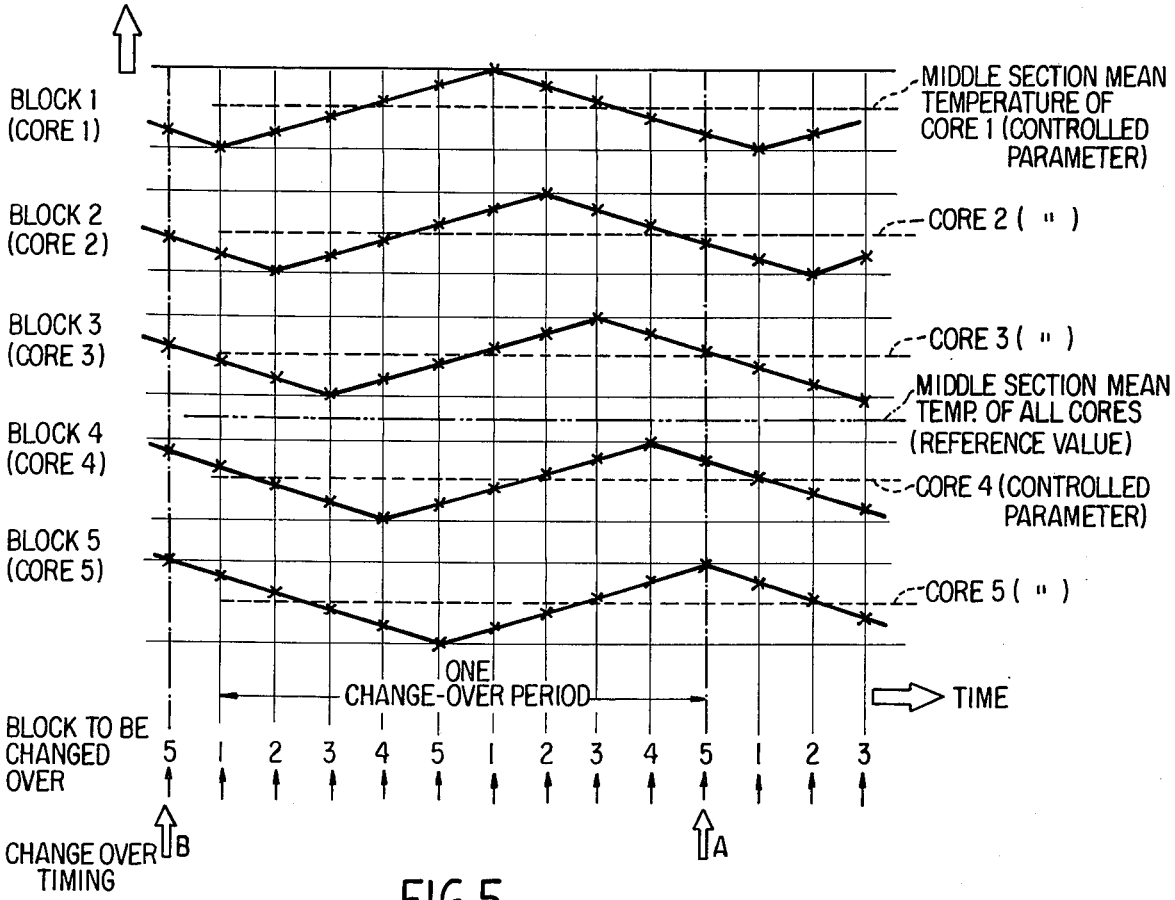
FIG. 5 is graphical representation of a temperature control sequence for a plurality of reversing heat exchangers constituted by five blocks each including one core of reversing heat exchanger.

Temperature sensing elements are disposed in each reversing heat exchanger to measure the temperatures $T_1$, $T_2$, . . . $T_n$ at the middle part of each, and the temperatures $T'_1$, $T'_2$, . . . $T'_n$ at the colds end of each. These temperatures are measured during a given change-over period (or twice per change-over period or once every two change-over periods) every time the flow paths of feed air stream and the return gas stream of the respective reversing heat exchanger are switched, and are stored in an automatic control. In the automatic control unit, the data is updated by the temperatures for the middle of each heat exchanger measured at the timing of change-over of the streams for the most recent change-over period with respect to the current time. Considering a case in which the air separation plant is comprised of five blocks each comprising one core of reversing heat exchanger as shown in FIG. 5, the temperatures at the middle of each reversing heat exchanger are measured and stored in the control unit at each timing when the streams of one block are switched (in the sequence 1-2-3-4-5-1-2). At the timing represented by A in FIG. 5, the middle section temperatures measured at the timing B are erased in the control unit, and, in their place, the middle section temperatures measured at the timing A are stored in the control unit. In this manner, the control unit updates the data on the middle section temperatures of the heat exchangers measured at the timing of the change-over for the most recent period. The measured data on the respective reversing heat exchangers for the latest change-over period are used to calculating the mean temperature at the middle sections of each heat exchanger, this being a parameter to be controlled. Further, the middle section temperatures of all of the heat exchangers are used for calculating a mean temperature for all heat exchangers, to provide a set value. Subsequently, automatic control valves of each heat exchanger are controlled such that the parameter to be controlled is brought close to the set value. To this end, the deviation between the reference and the controlled parameter is calculated, and from this deviation and deviation trend a manipulation value is obtained with respect to the current degree of opening of the control valve. In calculating the manipulation value, coarse and fine ranges relative to the deviation and deviation trend are provided, and a manipulation value is finally obtained after the maximum manipulation value which can be obtained at one time and the minimum manipulation value below which a conrol signal is not generated have been checked. The control valves of the respective heat exchangers are controlled in dependence on the manipulation values calculated in a manner previously described, thereby controlling the temperatures of the heat exchangers. In order to stabilize the effect of control operation, it is suspended for a certain interval after one action. At the end of this interval the control operation is started again. Normally, the time interval for which the control operation is suspended is controlled in dependence on the number of times the switching signals are generated by the control unit, and is determined to be approximately equal to the temperature time constant of all heat exchangers combined.

Figure 9:
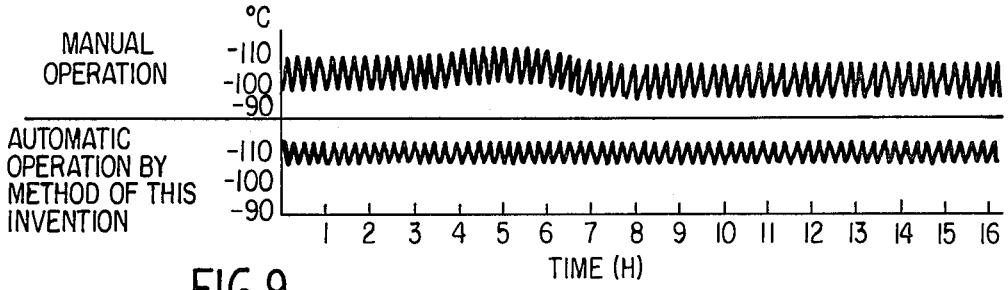
FIG. 9 is a graph illustrating a comparison between manual operation and the present invention's operation in control of the temperatures of the heat exchangers during normal operation.
Figure 10:
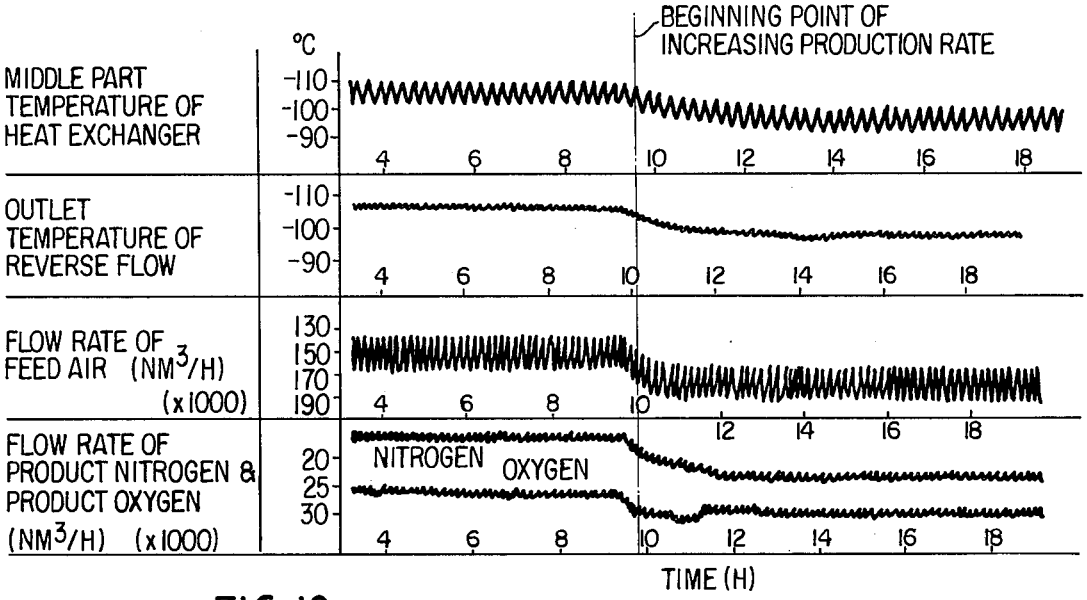
FIG. 10 is a graph illustrating control of the temperatures of the heat exchanges when the production rate is increased.
Figure 11:
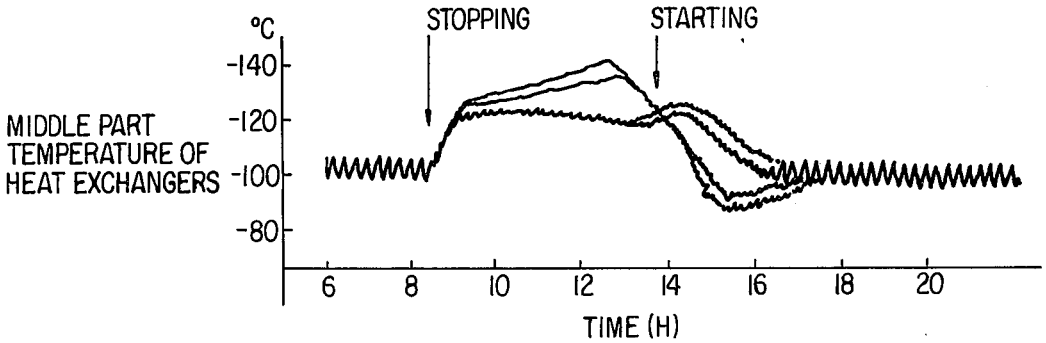
FIG. 11 is a graph illustrating the temperature variations during start-up operation after scheduled temporary shut down of the heat exchangers.

The control operation is performed by actuating either of product gas flow control valves $O_1, O_2, O_3, \ldots O_n$, return gas flow control valves $N_1, N_2, N_3, \ldots N_n$, feed air flow control valves $A_1, A_2, A_3, \ldots A_n$, and feed air block valves $B_1, B_2, B_3, \ldots B_n$ or reverse flow control valves disposed in the reverse flow lines of the respective heat exchangers at the cold ends thereof (not shown). Operating data obtained by the temperature control method described above is illustrated in FIGS. 9 to 11, from which it can be seen that the present method is quite effective for the temperature control of heat exchangers. FIG. 9 shows the variations in middle section temperatures of the reversing heat exchangers during the normal operating condition. In FIG. 9, it will be seen that during the normal operating condition, the thermal balance of all heat exchangers are satisfactorily maintained by the method of this invention. FIG. 10 shows an example of variations in middle section temperatures of respective heat exchangers during the operating condition in which gas production is increased. From this example, it will be seen that the all heat exchanges are operated in a satisfactory manner even when the thermal balance of the heat exchangers is varied due to production increase operation. FIG. 11 shows the temperature variations of the heat exchangers during start-up operation after scheduled temporary shut-down. In FIG. 11, it will be seen that the heat exchangers will operate to maintain thermal balance in an optimum manner without being adversely affected by the start-up operation, which causes transient fluctuations in the production process, or by the transition of the change-over periods for the reversing heat exchangers.

During temperature control of the heat exchangers, if a situation occurs in which the degrees of opening of the temperature control valves go outside the range in which control operation can be performed, it is possible to correct this condition and bring the temperature control valves back within the control range by utilizing one kind of or a combination of two kinds or more of automatic valves other than the temperature control valves.

To more clearly explain the correction process applied to actuate the temperature control valves previously noted, reference will be made to an examplary case in which the air separation plant of FIG. 4 comprises three blocks of reversing heat exchangers each block including three cores, and employing as temperature control valves either product gas flow control valves $O_1, O_2, O_3, \ldots O_n$ or return gas flow control valves $N_1, N_2, N_3, \ldots N_n$ and in which the middle section temperatures of the heat exchangers are measured for control purposes. However, it is to be noted that the above-noted correction process for actuating the temperature control valves may also be performed by measuring the temperatues of the heat exchangers at the other parts thereof and employing as the temperature control valves other kinds of above-mentioned control valves, for example, the feed air flow control valves, reverse flow control valves.

EXAMPLE 1

Figure 6:
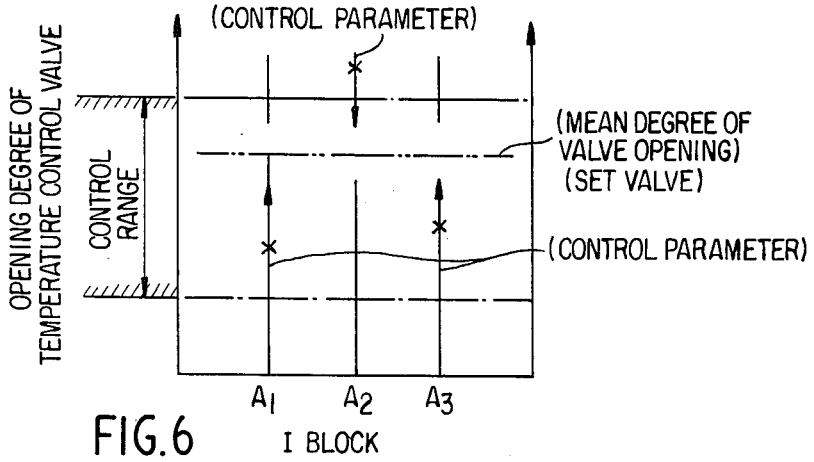
FIG. 6 is a graph illustrating a mode of controlling the openings of temperature control valves in a case in which the degree of opening of one of the temperature control valves of the reversing heat exchangers of a given block (viz., 1 block) is out of a predetermined control range.

When one of the temperature control valves of the respective reversing heat exchangers constituting one block (I block in FIG. 4) is out of control range as shown in FIG. 6, the degree of valve openings of the temperature control valves of the reversing heat exchanger in the I block are monitored to provide a control parameter. At the same time, a mean value of the degree of valve openings in I block is calculated from the measured values of valve openings to provide a set value. The feed air flow control valves $A_1$, $A_2$ and $A_3$ of each heat exchanger of the I block are then actuated such that the control parameter will reach the set value. To this end, the deviation of the control parameter with respect to the set value is derived, and the degrees of valve openings of the feed air flow control valves to be corrected from the current degrees of opening are calculated. When the feed air flow control valves $A_1$, $A_2$ and $A_3$ are actuated, a change will be caused in the middle section temperatures of each reversing heat exchanger in the I block such that the degrees of opening of the temperature control valves are brought back within the control range. If, accordingly, temperature control is continued, the temperature control valves can repeatedly be brought back into the control range. In order to stabilize the effect of the correcting operation, the operation is temporarily suspended. The correcting operation is subsequently started again when the temperature control valves are once more out of control range. It is to be noted that the above-noted correction process may be performed by employing as the temperature control valves the product gas flow control valves $O_1, O_2, O_3, \ldots O_n$ or the return gas flow control valves $N_1, N_2, N_3, \ldots N_n$.

EXAMPLE 2

Figure 7:
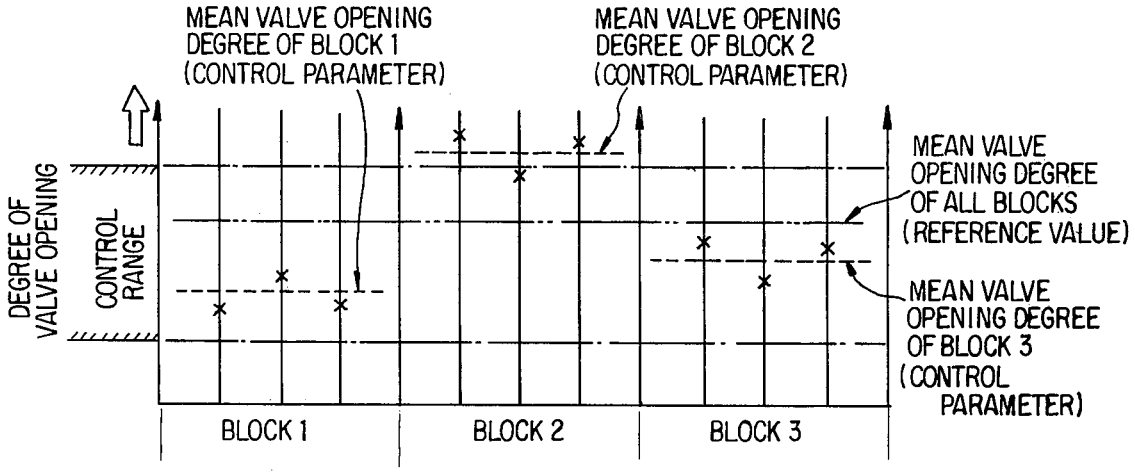
FIG. 7 is a graph illustrating a mode of controlling the degrees of opening of temperature control valves in a case in which the valve openings of all of the temperature control valves of the heat exchangers of given block are out of a control range.

In a case in which the mean degree of valve openings of the temperature control valves of a certain block exceeds the control range (see FIG. 7), a mean degree of valve opening for each block is calculated from the valve openings of the respective temperature control valves of the reversible heat exchangers in each block, and a mean valve opening for all blocks is calculated from the means valve openings of the individual blocks. The mean valve openings of the temperature control valves for each block are control parameters to be corrected, and the mean valve opening of all of the blocks is used as a set value. The feed air block valves $B_1, B_2, B_3, \ldots B_n$ are controlled such that the control parameters will reach the set value. To this end, deviation of the control parameter relative to the set value is derived, and the amount of correction of the degrees of valve openings of the feed air block valves $B_1, B_2, B_3, \ldots B_n$ relative to the current degrees of valve openings is calculated from the deviation between the control parameter and the set value. When the feed air block valves $B_1, B_2, B_3, \ldots B_n$ are actuated, a change will take place in the middle section temperatures of the respective reversing heat exchangers of each block such that the mean valve opening of the temperature control valves is brought within a control range. Thus, the temperature control valves can be controlled within the control range. In order to effect the correction of the temperature control valve opening in a stable manner, the correcting operation is temporarily suspended. It is resumed when the mean valve openings of the temperature control valves again go outside the control range. It is to be noted in this instance that the above-mentioned correction process may also be performed by employing as the temperature control valves the product gas flow control valves $O_1, O_2, O_3, \ldots O_n$ or the return gas flow control valves $N_1, N_2, N_3, \ldots N_n$ in a manner as previously described.

EXAMPLE 3

Figure 8:
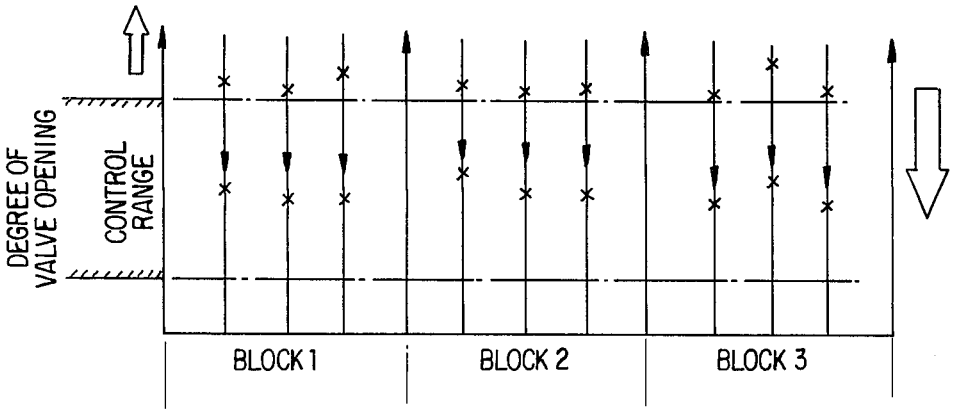
FIG. 8 is a graph illustrating a mode of controlling the degree of opening of the temperature control valves in a case in which the valve openings of the temperature control valves of the reversible heat exchangers of all blocks are out of control range.

In a case in which the mean valve openings of all temperature control valves for all of the blocks are out of the control range (see FIG. 8), the degrees of opening of temperature control valves of all heat exchangers are changed by the same amount, to cause the mean valve openings of all temperature control valves to come within the control range. In this instance, a flow balance for all of the heat exchangers is maintained by controlling a main product gas flow control valve D, in the case of the temperature control valves being constituted by the product gas flow control valves $O_1, O_2, O_3, \ldots O_n$ or by controlling a main return gas flow control valve C in the case of the temperature control valves being constituted by the return gas flow control valves $N_1, N_2, N_3, \ldots N_n$. Thus, the heat balance is maintained. In order to stabilize the effect of correction, the correcting operation is temporarily suspended, and the correction operation is started again when the mean valve openings of the temperature control valves once more go out of the control range.

Figure 12:
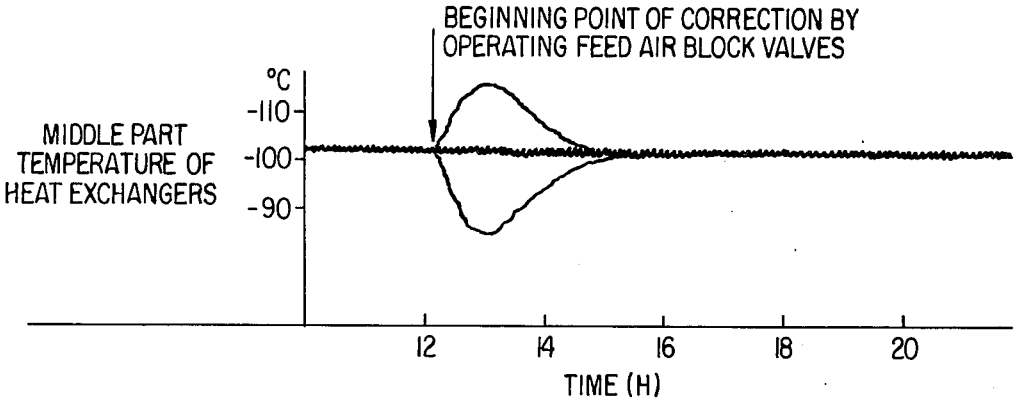
FIGS. 12 and 13 are views illustrating the results of correction of the degrees of valve opening of the temperature control valves by operating the feed air block valves.
Figure 13:
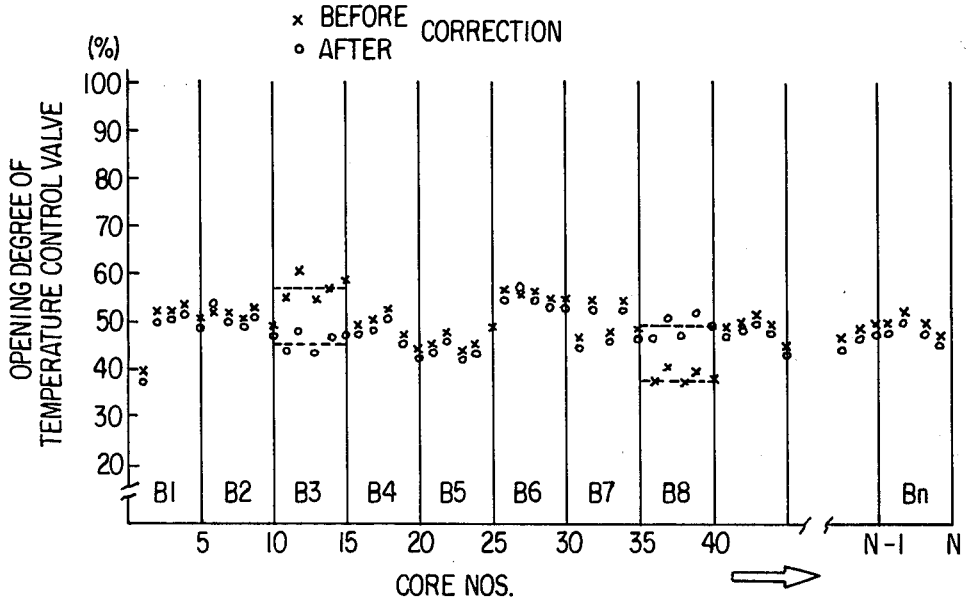

FIGS. 12 and 13 show an example of actual operating data for the operating points of the temperature control valves obtained utilizing the correction process. These show a notable improvement over conventional results. FIGS. 12 and 13 illustrate temperature variations for heat exchangers utilizing the correction process described above, and the process of correction of the valve openings, of the temperature control valves constituted by the feed air block valves, respectively. It will be seen from FIG. 13 that the temperature control valves in block 3 are corrected to decrease their degrees opening while the temperature control valves in block 8 are corrected to increase their degrees of opening. During the correcting process, an change will take place in the temperature of the outlet for the reverse flow nitrogen (which is approximately equal to the temperature of the middle section of the heat exchanger) in a direction determined by the direction in which the valve openings are corrected. As the temperature control is continued, the degrees of opening of only the temperature control valves for blocks 3 and 8 can be corrected without adversely affecting the valve openings of the temperature control valves of other blocks.

The above-mentioned temperature balancing control can be rapidly achieved by automatically determining the change-over periods of the heat exchangers in dependence on the temperature balance of the individual heat exchangers, and thereafter the thermal balance of a plurality of heat exchangers can be continuously maintained in a stable condition. As already described with reference to FIG. 5, if the streams were changed over or altered in all heat exchangers at the same time, the feed air channels would be momentarily closed, thereby interrupting the supply of feed air to the rectification column and resulting in thermal unbalance in the heat exchangers. To solve this problem, it is necessary to effect the change-over of the streams at different times, viz., at predetermined change-over periods. These are made short, to prevent the complete shut-off of each heat exchanger in the event the mean value of the temperatures of the heat exchangers during the most recent change-over period exceeds the upper or lower limit values or in the event that the temperatures of the heat exchangers change irregularly as in start-up operations. On the other hand, it is necessary to have a long duration of change-over period in order to decrease the influence on the rectification column of changes in the mean temperatures of the heat exchangers within the range between the upper and lower critical values.

A method of determining a change-over period for the heat exchangers will be described in detail with reference to FIGS. 14 to 16.

EXAMPLE 4

In a case in which the mean temperature of the respective cores is out of the range between the upper and lower critical values as shown in FIG. 14, the minimum duration of the change-over period can be determined as shown in FIG. 16.

EXAMPLE 5

In a case in which the mean temperature of all heat exchangers remains in the range between the upper and lower critical values, the change-over period will be determined in accordance with the maintenance of temperature balance about a mean temperature as shown by the graph of FIG. 16. The change-over period is determined by a parameter corresponding to the temperature balance of the heat exchangers, i.e., $T = T_{max} - T_{min}$. Thus, when the value of $T$ is small, the change-over period is large as shown in FIG. 16. As shown by the graph of FIG. 16, if the value of $T$ corresponding to the reference for the temperature balance is below a certain value, the change-over period is kept at a maximum value for a desired temperature balance in the heat exchangers.

If the method of varying the change-over period of the heat exchangers is combined with the temperature balancing method mentioned above, initial control of temperature balance of the heat exchangers can be more rapidly attained and a total thermal balance for a plurality of heat exchangers can be continuously maintained. This combined process is especially advantageous when fluctuations occur in thermal balance during start-up of the plant or when an accident occurs in the plant.

It will now be understood from the foregoing description that in accordance with the present invention a thermal balance is maintained in a number of reversing heat exchangers, contributing significantly to the stable operation and automation of production processes, which will be of great value in the industrial field.

What is claimed as new and desired to be secured by Letters Patent of the United States is:

1. A method of automatically balancing the temperature of a plurality of cores of reversing heat exchangers connected in parallel relationship wherein each heat exchanger has a feed stream and at least one heat medium stream, said feed streams and said heat medium stream being changed over alternately at a given interval, said method comprising the steps of:

detecting the temperature of a particular core of the reversing heat exchangers whenever the feed stream and the heat medium stream are altered;

calculating a mean temperature of the cores from the detected values on the latest certain change-over period with respect to the current time instant;

calculating a mean temperature of all heat exchangers from the calculated mean temperature;

calculating deviation and deviation trend in temperature of respective heat exchangers in depence on a difference between the mean temperature of each core and the mean temperature of all exchangers and feeding back a system deviation in dependence on said deviation and deviation trend to control valve for balancing the temperature of reversing heat exchangers.

2. A method according to claim 1, further comprising the steps of:

detecting the valve opening of each control valve;

calculating a mean valve opening of all control valves from detected valves;

calculating deviation and deviation trend in valve opening of respective exchangers depending on the difference between the valve opening of each valve and said calculated mean valve opening of all control valves; and feeding back a system deviation in dependence on said deviation and deviation trend to the control valve for balancing the temperature of reversing heat exchangers.

3. A method according to claim 1, further comprising the steps of:

changing the change-over period in dependence on mean temperature of respective cores from the said detected values during the most recent change-over period with respect to the current time instant.

* * * * *